US006753724B2

(12) United States Patent
Hanson

(10) Patent No.: US 6,753,724 B2
(45) Date of Patent: Jun. 22, 2004

(54) IMPEDANCE ENHANCEMENT CIRCUIT FOR CMOS LOW-VOLTAGE CURRENT SOURCE

(75) Inventor: Charles C. Hanson, Kenyon, MN (US)

(73) Assignee: International Business Machines Corporation, Armonk, NY (US)

( * ) Notice: Subject to any disclaimer, the term of this patent is extended or adjusted under 35 U.S.C. 154(b) by 29 days.

(21) Appl. No.: 10/132,890

(22) Filed: Apr. 25, 2002

(65) Prior Publication Data

US 2003/0201762 A1 Oct. 30, 2003

(51) Int. Cl.[7] ..... G05F 1/10; G05F 3/02
(52) U.S. Cl. ..... 327/543; 323/315
(58) Field of Search ..... 327/538, 540, 327/541, 543; 323/312, 315, 316

(56) References Cited

U.S. PATENT DOCUMENTS 5,689,178 A * 11/1997 Otake ..... 323/282
5,966,005 A 10/1999 Fujimori ..... 323/315
6,172,556 B1 * 1/2001 Prentice ..... 327/543
2003/0038671 A1 * 2/2003 Spalding, Jr. ..... 327/538

OTHER PUBLICATIONS

"An Improved Tail Current Source for Low Voltage Applications", by Fan You, Sherif H.K. Embabi, Member IEEE, J. Francisco Duque–Carrillo, Member, IEEE, and Edgar Sanchez–Sinencio, Fellow, IEEE, IEEE Journal of Solid–State Circuits, vol. 32, No. 8, Aug. 1997, pp. 1173–1180.
"CMOS Circuit Design, Layout, and Simulation", by R. Jacob Baker, ISBN 0–7803–3416–7, IEEE Order No. PC5689, copyright 1998, p. 427.

* cited by examiner

*Primary Examiner*—Terry D. Cunningham
*Assistant Examiner*—Quan Tra
(74) *Attorney, Agent, or Firm*—Robert R. Williams

(57) ABSTRACT

Methods and apparatus are provided for implementing a CMOS low voltage current source. The current source embodies a voltage feedback mechanism with a low voltage gain. The current source controls a gate of an output driver FET such that a substantially constant current is maintained, even for a portion of the linear range of operation of the output FET. The current source is suitable for driving transmission lines on printed wiring boards, or other application where the load is relatively heavy or complex, and where operation near the power supply is required.

13 Claims, 8 Drawing Sheets

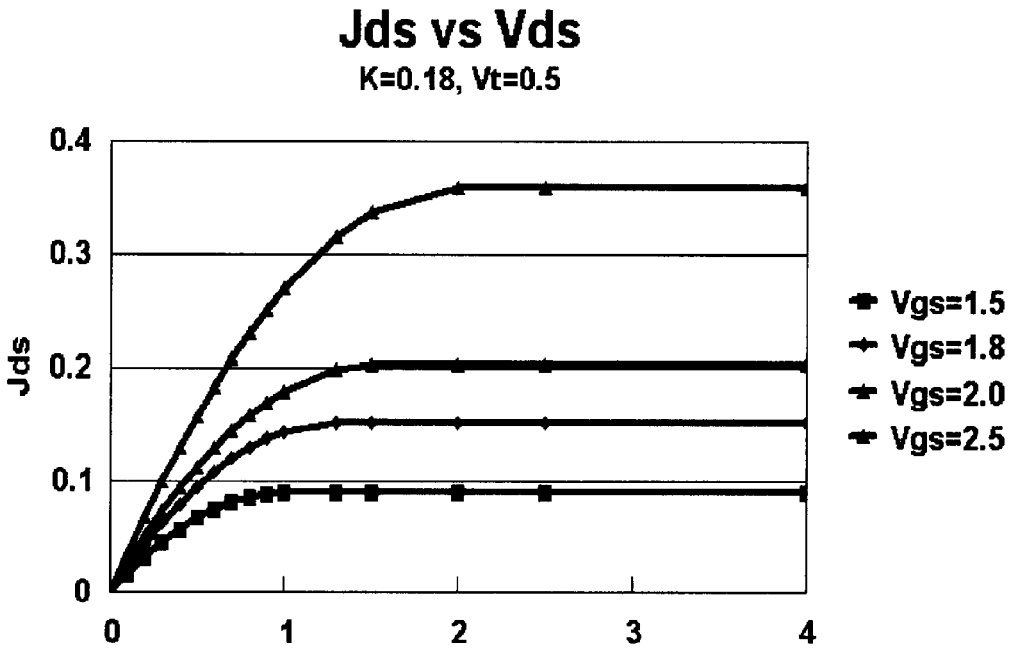
Fig. 2
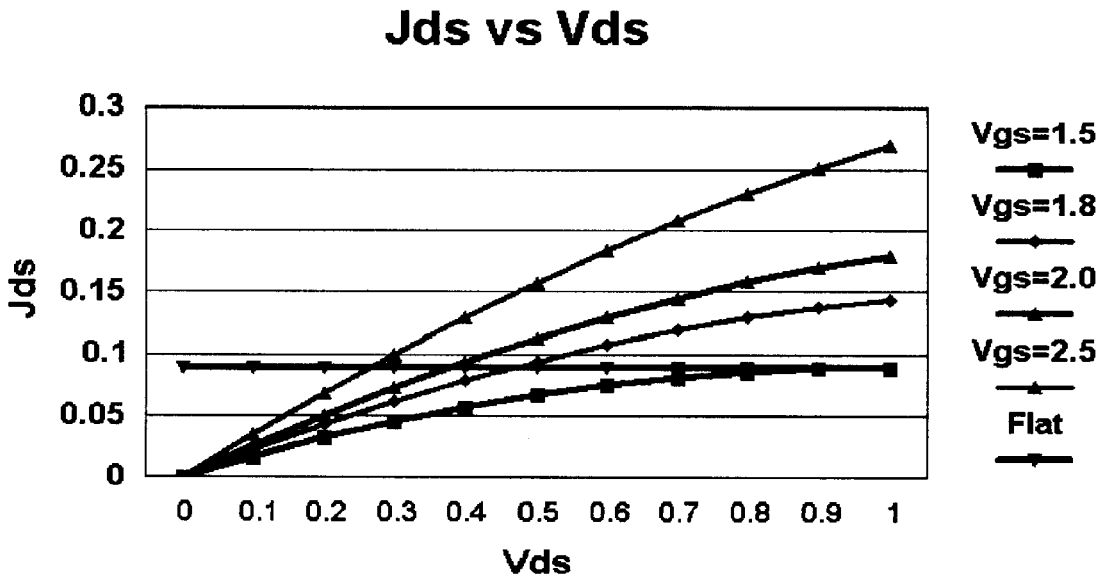
Fig. 3 K=0.18, Vt=0.5

IMPEDANCE ENHANCEMENT CIRCUIT FOR CMOS LOW-VOLTAGE CURRENT SOURCE

FIELD OF THE INVENTION

The present invention relates to current source circuits, and in particular, current source circuits utilized in Complementary Metal Oxide Semiconductor (CMOS) designs used in low-voltage applications.

DESCRIPTION OF THE RELATED ART

There are many techniques to provide a regulated current to a load circuit. One technique involves a current mirror. A conventional current mirror provides output current proportional to an input current. Separation between the input and output current ensures the output current can drive high impedance loads. Conventional current mirror designs have been implemented in both bipolar and CMOS technology. CMOS devices with short channel lengths and therefore faster operation have provided an impetus toward current mirrors based on CMOS technology.

An important aspect in designing a CMOS current mirror is to achieve an optimum matching between the input (or "bias") current and the output current. Typically, the output current is designed to traverse a load placed across output terminals of the current mirror. A bias transistor receives the bias current and produces a proportional bias voltage. The bias voltage is then placed on an output transistor configured to replicate (or "mirror") the bias current. Properly mirrored output current assumes the bias transistor and the output transistor are fabricated with similar traits. For this reason, most modern day current mirrors are fabricated on a monolithic substrate as part of an integrated circuit.

FIG. 1 shows a conventional current mirror 5. A pair of Field Effect Transistors (FETs) N1 and N2 are shown having their gate terminals mutually connected, along with mutually connected source terminals. Since both transistors are fabricated on a monolithic substrate consistent with one another, the transistors operate in similar fashion. That is, FETs N1 and N2 can be n-type transistors or p-type transistors. Transistor N1 is connected as a diode, meaning that the gate terminal is shorted to the drain terminal.

The threshold voltage (Vt) of N1 is designed to be substantially the same as the Vt of N2. The bias current (Ibias) applied to N1 through resistor R generates a bias voltage (Vbias) at the gate terminal of N1. Vbias is substantially equal to the Vt of N1, along with additional turn-on voltage (Von) required for current flow of Ibias. The relation between Von and Ibias is described in the following equations, and is sometimes referred to as the FET square law relationship:

$$Ibias=K1*W/L*(Vgs-Vt)^2, \quad (1)$$

Where K1 is the FET gain factor, W is the channel width, L is the channel length and Vgs is the gate-to-source voltage, and where $$Von=Vgs-Vt, \quad (2)$$

Which reduces to $$Von=(Ibias/(K1*W/L))^{1/2} \quad (3)$$

Von is generally referred to as the saturation voltage of the FET. If the drain-to-source voltage (Vds) of the FET is larger than the voltage Von, the FET will operate in the "saturation" region. On the contrary, if Vds is lower than Von, the FET will enter the "linear" region which, when entered, significantly degrades the gain and output impedance properties of the FET.

In the instance shown, the diode-connection of N1 forces Vds of N1 to be Vt+Von, which is larger than Von such that N1 is automatically placed in saturation. Whether N2 is in saturation or not depends on the drain voltage of node 2. The threshold voltage Vt of N1 is designed to be substantially the same as N2.

If N1 and N2 in FIG. 1 have matched parameters (channel width, channel length, threshold voltage, etc) current Ibias will be reproduced, or mirrored, through N2 as Iout. Furthermore, the mirrored current Iout will flow through whatever circuit is connected to output node 2. A circuit connected to output node 2 (interchangeably referred to as "Vout") is referred to as the load of the current mirror 5.

Proper design of a current mirror must take into account at least two important characteristics involved in all current mirrors. First, the output impedance should be as high as possible. Various applications will place different impedance lower limits on the circuit. Second, the output impedance should remain as high as possible for a wide range, including the case where there is little drain to source voltage across N2, in FIG. 1. It is assumed, too, that the supply voltage is high enough to provide biasing for the current mirror circuitry.

A number of CMOS current source designs have been described previously, most of which operate to the point that the output FET device leaves the saturated region and enters the linear region of operation.

"CMOS Circuit Design, Layout, and Simulation", by R. Jacob Baker, ISBN 0-7803-3416-7, IEEE (Institute of Electrical and Electronic Engineers) Order Number: PC5689, copyright 1998, provides a description of CMOS current source design techniques beginning on page 427, and describes biasing schemes that provide operation with relatively low voltage across the output stage of the current source, while maintaining the FET devices in the output stage in a saturated condition.

U.S. Pat. No. 5,966,005, "Low Voltage, Self Cascode Current Mirror" by Fujimori, describes another CMOS current mirror with an output stage comprised of cascode connected FET devices.

"An Improved Tail Current Source for Low Voltage Applications", by Fan You, et al, in the *IEEE Journal of Solid-State Circuits,* Vol. 32, No. 8, August 1997, describes a high impedance current source capable of operating at low bias voltage. Although the described circuit appears to function well driving a small, fixed load, it has two loops that can potentially be unstable. Instability may result if the current source were used to drive a signal on a more heavily loaded, or more complex load, such as a computer transmission line, including discontinuities involving printed wiring board (PWB) signal wires, which have connectors, wiring vias, and so forth.

Therefore, there exists a need for a low voltage current source capable of driving PWB transmission lines with low bias voltages.

SUMMARY OF THE INVENTION

A principle object of the present invention is to provide an improved method and apparatus for providing a high output impedance current source capable of a wide range of output voltage, while driving a large capacitive load, or a load with impedance discontinuities, as are often found in Printed Wiring Board (PWB) signal carrying wires. The present invention comprises a driver and a voltage control mechanism. The voltage control mechanism is a low-gain circuit that senses the voltage on an output of the driver and adjusts the input voltage of the driver in such a manner as to maintain relatively high driver output impedance, even as the output voltage becomes close to a power supply voltage.

An embodiment of the present invention is to provide an improved method and apparatus for providing a high output impedance current source capable of reliably operating when coupled to heavily loaded or complex loads. The current source has an output voltage ranging from the entire supply voltage (Vdd) to less than a single Vds(sat), where Vds(sat) is a Field Effect Transistor (FET) drain to source voltage above which the FET is operating in its saturated region, and below which the FET is operating in its linear region.

In one embodiment, a driver's output voltage is fed back to a voltage control mechanism. If the driver's output voltage falls past a predetermined voltage, the voltage control mechanism adjusts an input to the driver such that the driver's current remains substantially constant for some voltage range under the predetermined voltage.

In one embodiment of the present invention, the output voltage is compared against a reference voltage in a differential amplifier. If the output voltage is above the reference voltage, the current source operates as a conventional, non-cascode current source in which the output FET is operated in its saturated region. If the output voltage drops below the reference voltage, a gate voltage on the current source output FET will be increased in order to maintain approximately the same current, even though the FET has entered the linear region of operation. Since the output current remains relatively constant in spite of variations in the output voltage, the output impedance of the current source remains high.

In one embodiment of the present invention, a differential amplifier modifies the magnitude of a bias current entering a drain of a current mirror FET, which drain is also electrically coupled to a gate of the same FET. Modification of the bias current alters the drain voltage of the current mirror FET, which is further coupled to a gate on an output FET. The gate voltage of the output FET is modified such that the output current remains relatively constant.

In another embodiment of the present invention, a differential amplifier detects that the output voltage drops below a reference voltage and provides a current coupled to a resistor through which a bias current Ibias flows from a source of a current mirror FET, thereby raising the voltage on the source of the current mirror FET relative to a gate and drain of the current mirror FET, and reducing the bias current. The drain of the current mirror FET will rise accordingly. The drain of the current mirror FET is electrically coupled to a gate of the output FET. The rise in gate voltage of the output FET maintains a relatively constant output current, even though the output FET has entered its linear range of operation.

BRIEF DESCRIPTION OF THE DRAWINGS

FIG. 2 shows a graph of an FET drain current (Jds) versus drain to source voltage (Vds) for several gate to source voltages (Vgs). A wide range of drain to source voltage is shown in order to include both the FET linear region and the FET saturated region.

FIG. 3 shows a graph of an FET drain current versus drain to source voltage for several gate to source voltages. This figure focuses primarily on the linear region of operation of the FET. In addition, an "ideal", or "flat", constant current line is shown.

DETAILED DESCRIPTION OF THE PREFERRED EMBODIMENTS

Figure 1:
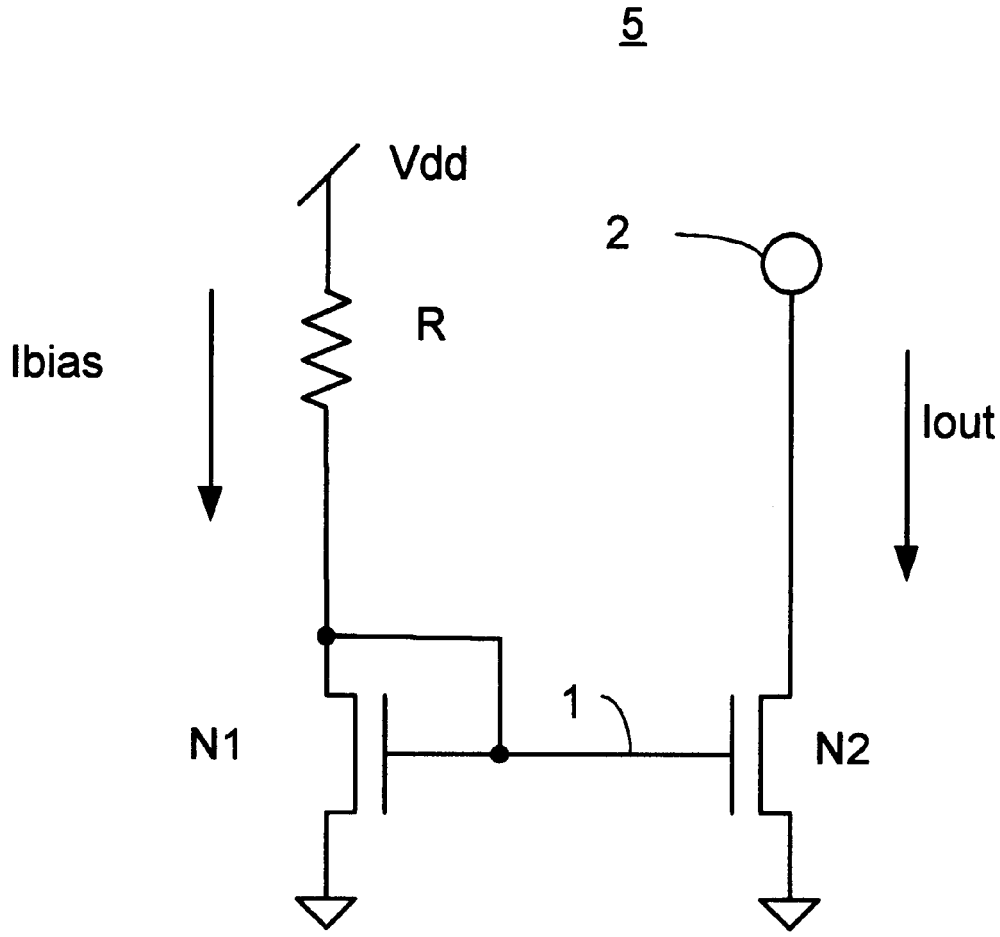
Fig. 1 Prior Art
FIG. 1 shows a conventional current mirror current source circuit.

Having reference now to the figures, and in particular FIG. 1, there is shown a conventional current mirror current source 5, which was described in detail earlier. Current lout will decrease rapidly as the drain to source voltage (Vds) of N2 decreases into the linear region of operation, limiting the usefulness of this circuit.

FIG. 2 shows an ideal graph of drain to source current in milliamps (Jds) versus Vds of an FET, using the ideal, textbook, equations 4 and 5, and where Vgs is the gate to source voltage of a FET; Vt is the threshold voltage of a FET.

$$Jds=K/2*(Vgs-Vt)**2 \text{ when } Vds>Vgs-Vt \text{ (saturated region), and} \quad (4)$$

$$Jds=K*Vds*(Vgs-Vt-Vds/2) \text{ when } Vds<Vgs-Vt \text{ (linear region).} \quad (5)$$

$K=2*K1*W/L$ where K1 is the FET gain factor as described earlier, and W is the FET channel width. L is the effective FET channel length. (6)

The ideal equation 4, for saturated operation predicts infinite impedance when an FET is in its saturated region. That is, the equation predicts that no variation of Jds occurs as Vds changes when the FET is operated in its saturated region. In practice, some very slight increase in Jds current does occur as Vds increases, in particular, for short channel FETs. In cases where extremely high impedance is required, cascode outputs are utilized, as taught in the references given above. The cascode designs reduce Vds variation on an output FET that determines the output current. Current mirror current source circuits are usually designed with longer than minimum channel lengths, however, and for many applications, sufficiently high impedance is attained without use of cascode FETs in the output of the circuit.

Often of more interest than ultrahigh impedance is the need to maintain a reasonably high impedance of the current mirror current source as the output voltage becomes small, including where the output voltage drops below Vgs−Vt, causing the output FET to enter its linear region.

FIG. 3 shows the same Jds versus Vds graph as FIG. 2, but focuses primarily on the range of Vds where the output FET is operating in the linear region. In addition, a line (entitled "Flat" in the legend) has been added. The "Flat" line is an extension of the "Vgs=1.5 v" saturated current of 0.090 mA which would be a desirable characteristic, thereby maintaining a high output impedance even though the output FET has entered the linear region of operation.

To operate at such high impedance when the output FET is operating in the linear region, the Vgs voltage of the output FET must be controlled.

$$Jds=K*Vds*(Vgs-Vt-Vds/2) \quad (7)$$

Equation 7 describes drain to source current (Jds) of an FET in the linear region. For the same Jds current at different Vds voltages, and with K and Vt being constants, and Vgs1 and Vds1 being the Vgs and Vds at a first operating point, and Vgs2 and Vds2 being the Vgs and Vds at a second operating point, $$Jds1=K*Vds1*(Vgs1-Vt-(Vds1)/2) \quad (8)$$

$$Jds2=K*Vds2*(Vgs2-Vt-(Vds2)/2) \quad (9)$$

if Jds1=Jds2, $$Vds1*(Vgs1-Vt-(Vds1)/2)=Vds2*(Vgs2-Vt-(Vds2)/2) \quad (10)$$

Solving for Vgs2, to determine what the gate to source voltage of the FET must be to keep Jds1=Jds2, $$Vgs2=(Vds1*Vgs1-Vds1*Vt-(Vds1**2)/2+Vds2*Vt+(Vds2**2)/2))/Vds2 \quad (11)$$

Figure 4:
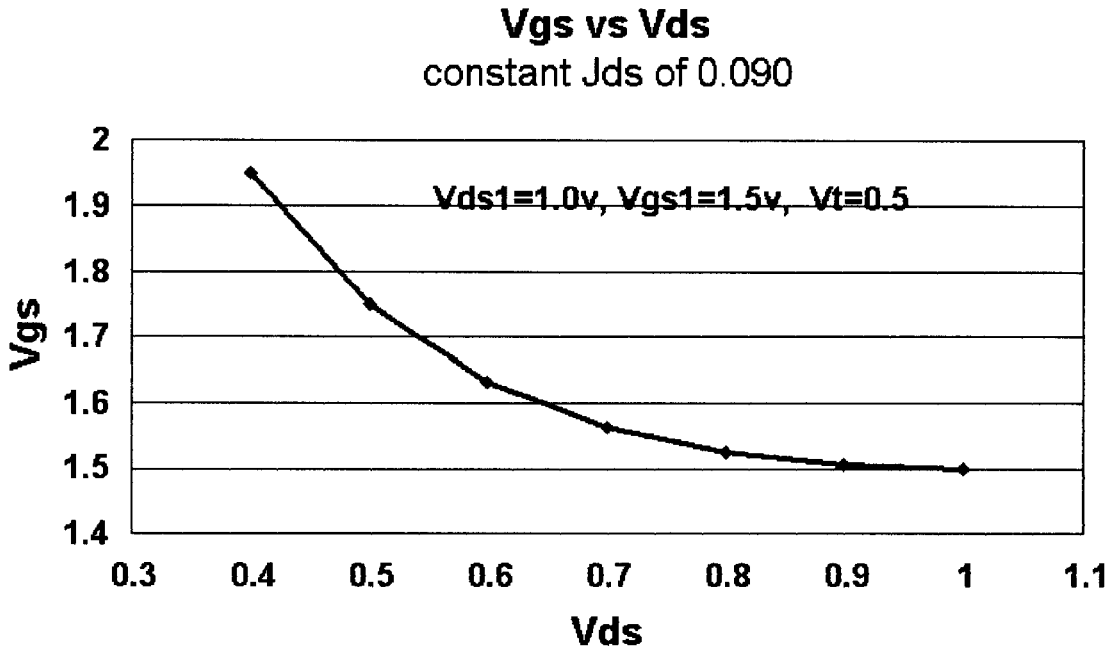
FIG. 4 shows a exemplary graph of how a gate to source voltage of an output FET would have to vary in order to maintain a constant drain to source current while the FET is operating in its linear region.

Using equation 11, with a case where Vds1=1 (where the lowest curve in FIG. 2 and FIG. 3 enters the linear region, with Vgs1=1.5 v and Vt=0.5), the 0.09 mA current is maintained if a Vgs voltage is controlled versus Vds as shown in FIG. 4. The values in the chart in FIG. 4 could also be obtained graphically by determining at what Vds voltages the various gate voltages intersect the "Flat" line in FIG. 3. Obviously, the preceding is only an exemplary case, showing how a particular line of the set of saturated Jds versus Vds lines can be effectively extended into the linear region of the FET by controlling the Vgs of the FET.

An inspection of FIG. 4 shows that only a modest rise in Vgs is required for the first several hundred millivolts (mV) of Vds drop into the linear region, requiring only a low-gain amplifier, with a voltage gain under 1, to provide. A less than 1 gain is important to provide stability over a wide range of loading at the output of the current mirror current source. For example, in FIG. 4, if Vds drops from 1 Volt to 0.700 Volts, a difference of 300 mV, Vgs needs to rise only approximately 60 mV to maintain a constant Jds. Voltage gain used here means the absolute value of the voltage gain. For the circuits shown below, and described in this paragraph for FIG. 4, a reduction of Vds when the FET is in the linear region of operation requires an increase in Vgs. Thus, the voltage gain is technically negative, but for simplicity, voltage gain will herein refer to the absolute value of the ratio of voltages as described.

Figure 5:
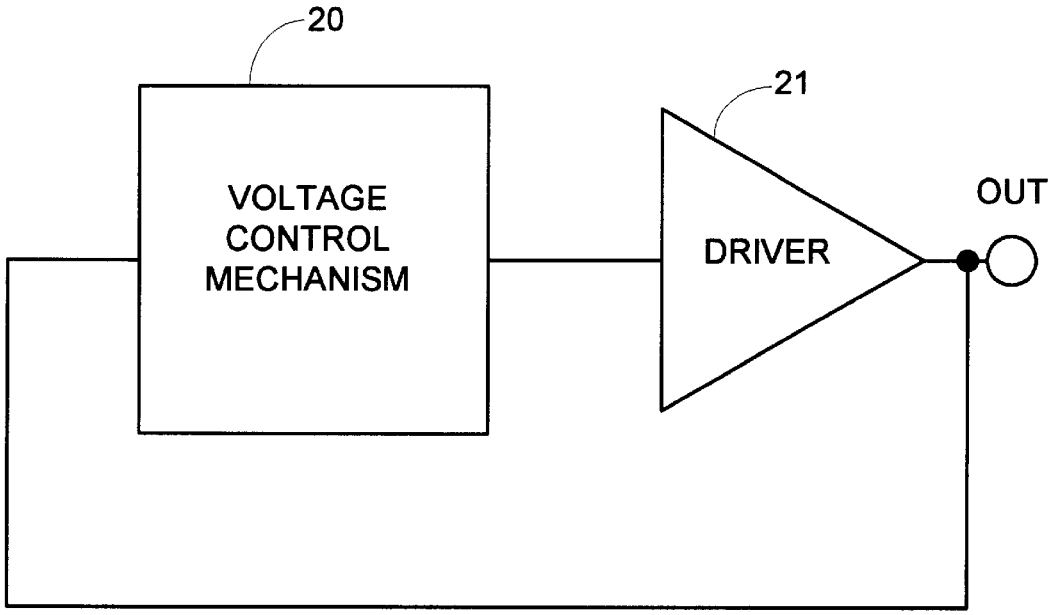
FIG. 5 shows a block diagram of a preferred embodiment of the invention

FIG. 5 shows a high-level block diagram of the current source. An output OUT is driven by a driver 21, which sources or sinks a current at the output OUT. A voltage feedback mechanism 20 is coupled to the output OUT, and provides a control voltage to driver 21 that keeps the current substantially constant, even as the voltage on the output OUT becomes near a voltage supply used by driver 21.

Figure 6:
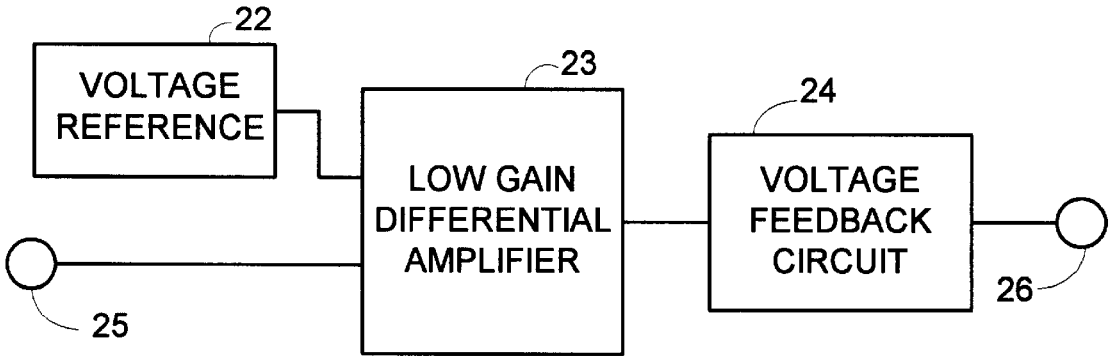
FIG. 6 shows a block diagram of a voltage control mechanism used in a preferred embodiment of the invention.

FIG. 6 shows a block diagram of the voltage feedback mechanism 20 of FIG. 5. A voltage reference 22 provides a reference voltage that is coupled to a first input of a low-gain differential amplifier 23. A second input to the low-gain differential amplifier 23 is coupled to port 25. Port 25 is the input of the voltage control mechanism 20 of FIG. 5, and is thus coupled to output OUT. The low-gain differential amplifier 23 is coupled to a voltage feedback circuit 24, which produces a voltage on port 26. Port 26 is the output of voltage control mechanism 20, and is thus coupled to the input of driver 21. Control of this voltage is required to maintain a substantially constant current to be sourced or sunk by driver 21 of FIG. 5. Voltage gain of the voltage control mechanism is preferably less than 1 for stability purposes when driving large capacitive loads or Printed Wiring Board signal lines that have discontinuities such as vias and connectors, but could be greater than 1 under some loading conditions coupled to output OUT. If the voltage gain is greater than one, some consideration of stability is required.

Figure 7:
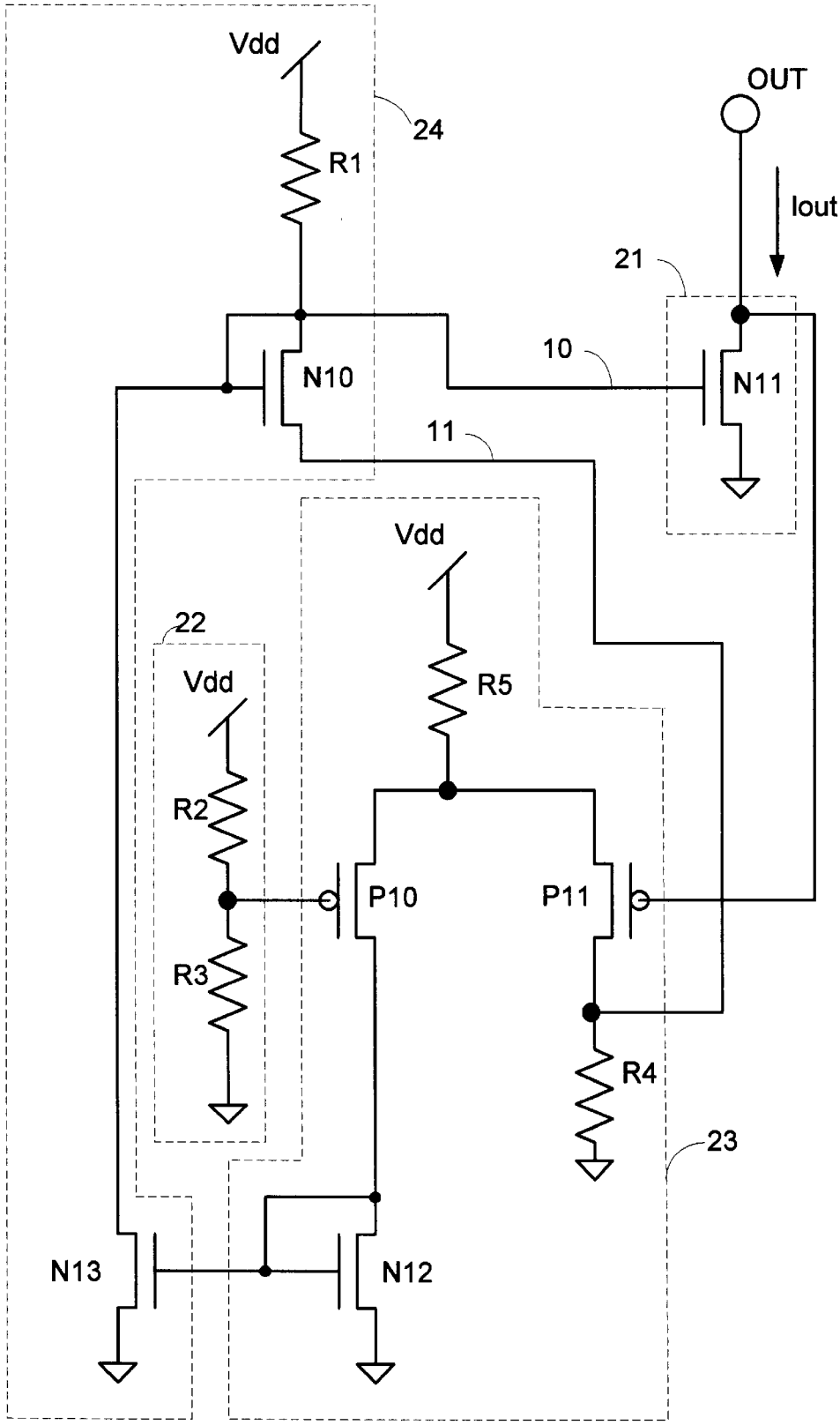
FIG. 7 shows a schematic of a preferred embodiment of the invention.

FIG. 7 shows a preferred embodiment of a circuit that provides the low-gain voltage control of the output FET. Dotted lines identify, and are numbered the same as, the major components of the invention in this embodiment as defined in the high-level block diagrams FIG. 5 and FIG. 6. Driver 21 in FIG. 7 is an N-channel Field Effect Transistor (NFET) N11. Voltage reference 22 comprises a voltage divider comprising resistors R2 and R3 coupled between Vdd and ground. The low-gain differential amplifier 23 comprises resistors R5 and R4, P-channel Field Effect Transistors (PFETs) P10 and P11, and NFET N12. The voltage feedback circuit 24 comprises NFETs N10, N13, and resistor R1. A detailed description of how the circuit elements operate together follows.

Resistor R1 is a bias resistor, providing a current bias source. A first end of resistor R1 is coupled to a positive voltage supply, Vdd. A second end of resistor R1 is coupled to node 10. Node 10 electrically couples the second end of resistor R1, a gate of an N11, a drain of an N10, a gate of N10, and a drain of an N13. N11 is the output FET of the current mirror current source circuit, and is the current source driver. A drain of N11 is coupled to node OUT, an output of the current source circuit. Current Iout flows from the drain to a source of N11. A source of N11 is coupled to ground.

Those skilled in the art will appreciate that the function of bias resistor R1 could easily be performed by many other circuit techniques. For example, use of a current mirror to supply bias current instead of R1 would be an alternative. A PFET transistor connected in a saturated configuration, with a source coupled to VDD and a gate and drain coupled together and further coupled to node 10 would be an alternative. A PFET connected in a linear load configuration, with a source coupled to VDD, a gate coupled to ground, and a source coupled to node 10 would also be an alternative.

Resistor R5 provides a current bias to low-gain differential amplifier 23, differential amplifier 23 further comprising P10, P11, resistor R4, and N12. A source of P10 and a source of P11 are coupled to a first end of R5; a second end of R5 is coupled to a positive supply voltage, Vdd. A gate of P10 is coupled to a first input of differential amplifier 23. A gate of P11 is coupled to a second input of differential amplifier 23. A drain of P10 is coupled to a gate and a drain of N12. The drain of P10 is further coupled to a first output of differential amplifier 23. Resistor R4 has a first end coupled to a source of N10, and a drain of P11. The drain of P11 is further coupled to a second output of differential amplifier 23, and is also coupled to node 11. R4 has a second end, which is coupled to ground. A gate of N13 is also coupled to the drain of P10, the drain of N12, and the gate of N12. A source of N13 is coupled to ground. A source of N12 is coupled to ground.

Those skilled in the art will understand that resistor R4 is a load, and other loads could be substituted, such as a suitable current source.

Those skilled in the art will recognize that many suitable alternatives to resistor R5 exist that could provide a current bias. Some alternatives for supplying bias current were given above, in the discussion of R1.

Resistors R2 and R3 comprise voltage reference 22 which supplies a voltage reference to the first input of differential amplifier 23. The second input of differential amplifier 23 is coupled to the drain of N11, which is the driver of the output of the current source circuit.

Voltage reference 22 is set so that when the voltage at node OUT is relatively high, and N11 is operating in a saturated region, all, or most, of the bias current flowing through R5 flows through P10 and N12.

N13 is a feedback FET that mirrors the current flowing through N12, depending on the ratio of the widths of N12 and N13. N12 and N13 are designed to have the same channel length and Vt. The current flowing through N13, together with the drain to source current of N10 flows through R1, establishing the voltage of node 10. In the exemplary drawing of FIG. 7, the source of N11 is coupled to ground, and node 10 is coupled to the gate of output NFET N11, establishing the Vgs of N11.

Voltage reference 22 is set such that as the voltage at node OUT decreases to the point that N11 enters its linear region of operation, some of the current flowing through R5 begins to flow through P11 rather than P10. As this occurs, less current flows through N12, as well as N12's mirror FET, N13. N13's current also flows through R1, as explained above. As less current flows through N13, less current also therefore flows through R1. Less current flowing through R1 raises the voltage at node 10, providing a higher Vgs for N11. As less current flows through P10, more current flows through P11 in differential amplifier 23. As more current flows through P11, the voltage on node 11 rises. Node 11 is coupled to the source of N10. A rising voltage at the source of N10 helps ensure that N10 current does not significantly change as the voltage on node 10 increases. A large increase in current through N10 could offset the reduction in current through N13 and prevent node 10 from rising.

Figure 10:
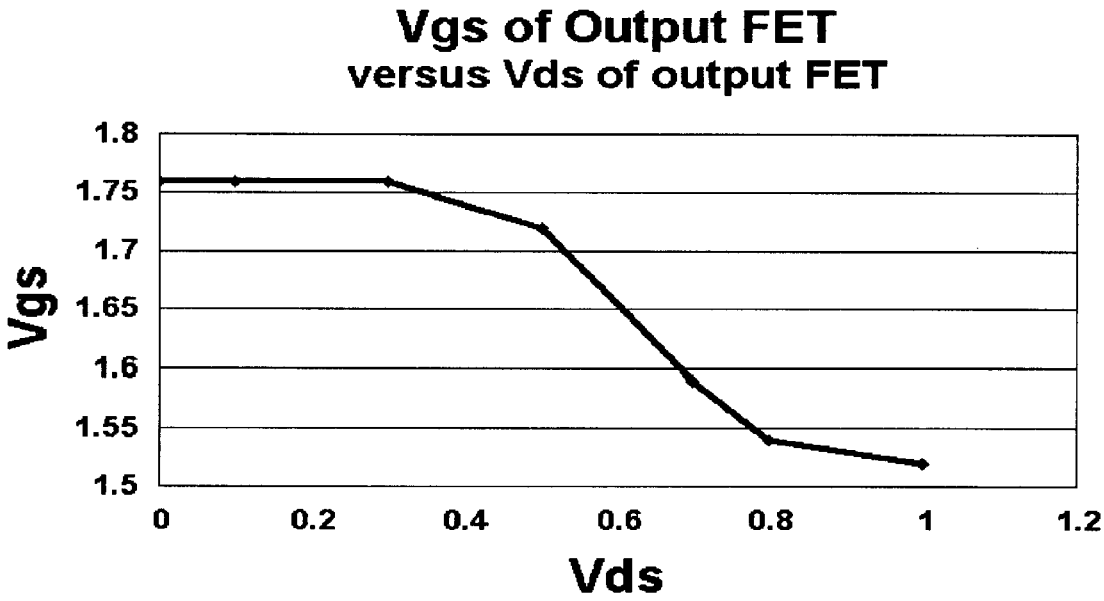
FIG. 10 shows a graph of the gate to source voltage of the output FET of FIG. 7 versus the drain to source voltage of the output FET of FIG. 7.

FIG. 10 shows a Vgs versus Vds chart resulting from the embodiment of FIG. 7, showing creation of a gate to source voltage on N11 approximating the ideal gate to source voltage curve of FIG. 4, for the drain to source voltage of N11 ranging from 1 Volt down to approximately 0.5 Volts.

Figure 11:
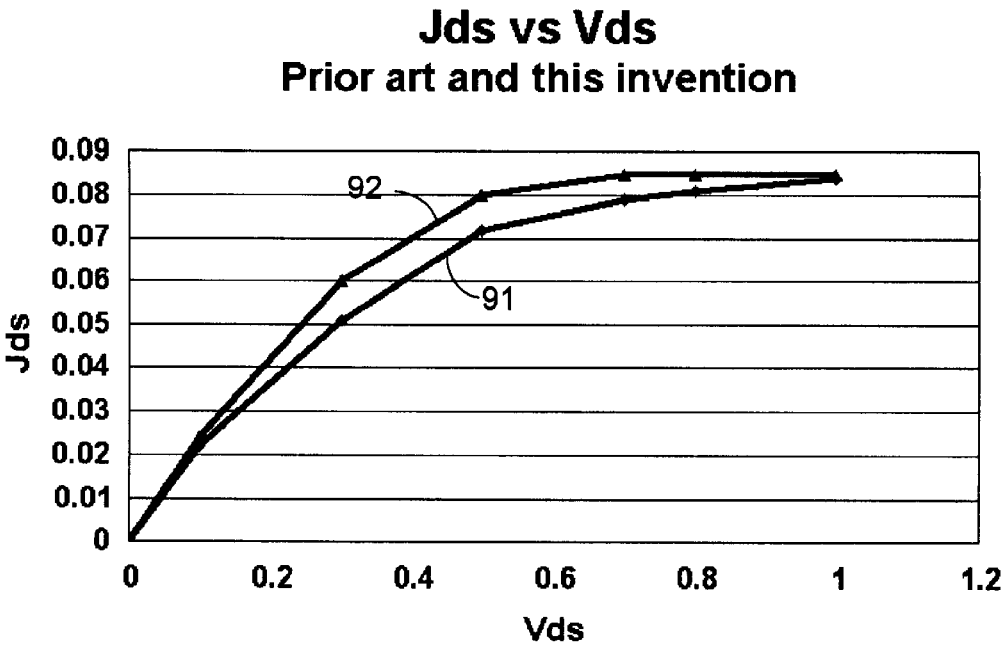
FIG. 11 shows a graph of the drain to source current of the output FET of FIG. 7 versus the drain to source voltage of the output FET of FIG. 7. The drain to source current of the output FET of FIG. 1 versus the drain to source voltage of the output FET of FIG. 1 is also shown.

FIG. 11 shows the output current 92 (in milliamps) of the current source of FIG. 7, as well as the output current 91 of a conventional current mirror current source as depicted in FIG. 1. The current of the embodiment of FIG. 7 changes approximately 0.004 mA as Vds changes from 1.0 v to 0.5 v. This yields an impedance of 0.5 v/4E-6 amps, or 125,000 ohms. The current of the circuit of FIG. 1 changes approximately 0.013 mA as Vds changes from 1.0 v to 0.5 v. This yields an impedance of 0.5 v/13E-6 amps, or 38,000 ohms.

Figure 8:
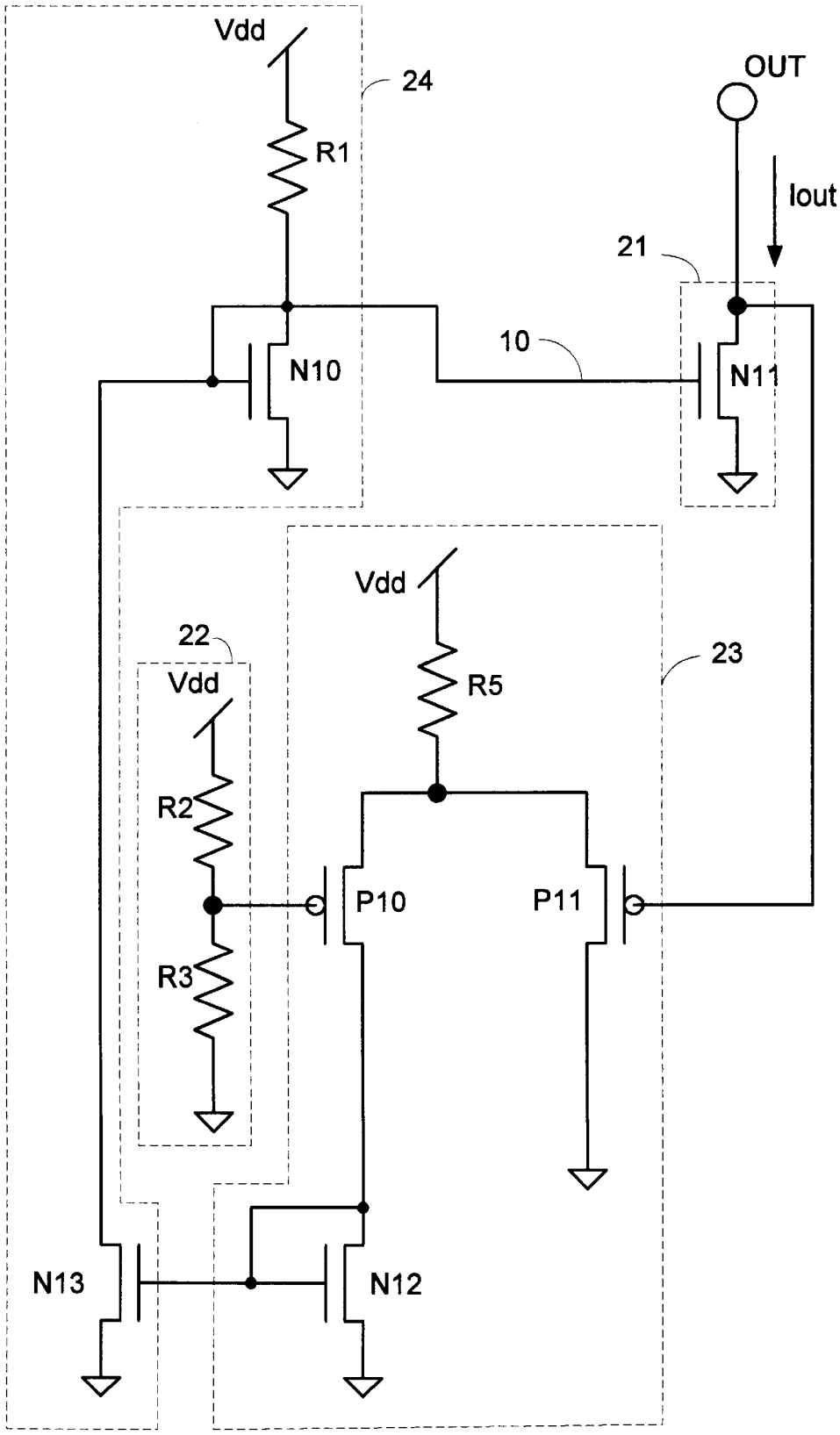
FIG. 8 shows a schematic of a second embodiment of the invention.

FIG. 8 shows a variant embodiment of the current mirror current source of FIG. 7. Elements in FIG. 8 are named the same as the equivalent elements in FIG. 5, FIG. 6, and FIG. 7. In the embodiment of FIG. 8, the source of N10 is coupled to ground. The drain of P11 is also coupled to ground. Resistor R4 has been eliminated. In the embodiment of FIG. 8, the reference voltage created by voltage reference 22 is again set by the voltage divider comprising R2 and R3 such that when the voltage at node OUT begins to fall below the saturated region of N11, differential amplifier 23 begins to shift current from P10 to P11. In the embodiment of FIG. 8, as the Vds of N11 decreases to a voltage near the reference voltage set by voltage reference 22 comprising R2 and R3, current through P10 decreases, also reducing current through N12. N13 mirrors current through N12, N13 current decreases also, thus raising the node 10 voltage. Some increase in current through N10 will occur because of the increased Vgs, reducing the net gain of the feedback.

Figure 9:
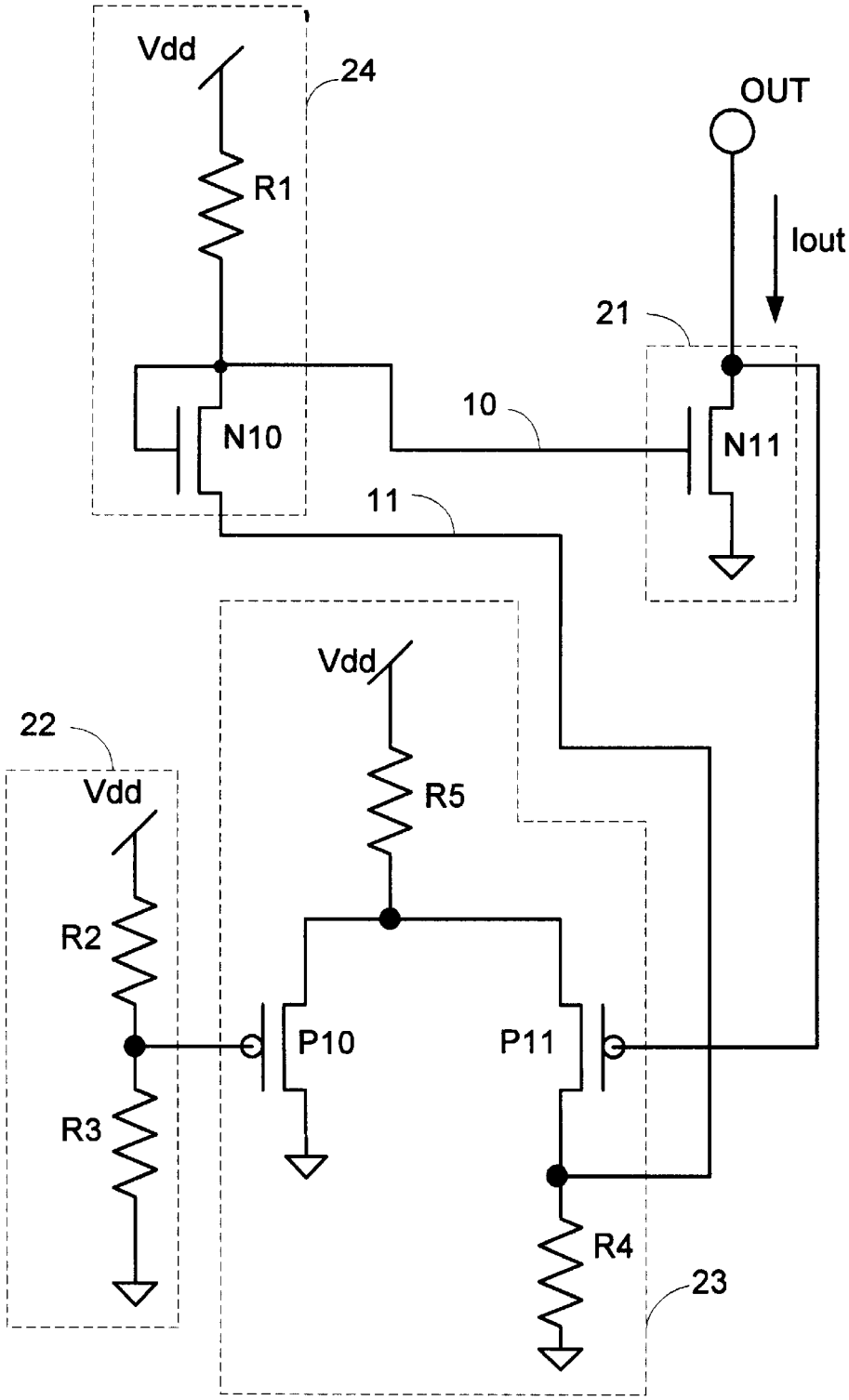
FIG. 9 shows a schematic of a third embodiment of the invention.

FIG. 9 shows another variant embodiment of the current mirror current source of FIG. 7. Elements in FIG. 9 are named the same as the equivalent elements in FIG. 5, FIG. 6, and FIG. 7. In the embodiment of FIG. 9, N12 and N13 are eliminated. In the embodiment of FIG. 9, the reference voltage output of voltage reference 22 is again set such that when the voltage at node OUT begins to fall below the saturated region of N11, differential amplifier 23 begins to shift current from P10 to P11. As current flow through P11 increases, the voltage on node 11 increases, thereby reducing current through N10 and raising the voltage on node 10. As before, raising the voltage on node 10 in a manner approximating the ideal voltage curve shown in FIG. 4 keeps the current source output current relatively constant, even though the output FET has entered a linear region of operation.

The present invention has been described in detail with the current source driver being an NFET device that draws current into node OUT, with the current flowing through the NFET into ground. It will be clear to those skilled in the art that ground could in fact be any potential sufficiently below Vdd to bias and operate the FET devices described. Furthermore, it will be clear to those skilled in the art that a complementary circuit could be produced with the driver being a PFET device producing an output current flowing from Vdd, through the PFET device to the node OUT, with other portions of the circuitry replaced by complementary versions of the circuit elements in the figures and description given in detail above.

While the present invention has been described with reference to the details of the embodiments of the invention shown in the drawings, these details are not intended to limit the scope of the invention as claimed in the appended claims.

What is claimed is:

1. A current source with a current source output, capable of driving a large capacitive load and capable of driving Printed Wiring Board signal lines, and maintaining high impedance over a wide range of voltage at said output, comprising:

a voltage control mechanism with a voltage control input and a voltage control output, the voltage control mechanism further comprising:

a voltage reference having a voltage reference output;

a low-gain differential amplifier having a first input coupled to said voltage reference output, a second input coupled to said current source output, and at least one amplifier output; and a voltage feedback circuit coupled to at least one of said amplifier outputs and further coupled to said voltage control output; and a driver having a driver input coupled to said voltage control output, and a driver output coupled to said voltage control input and said current source output, said driver output producing a current responsive to a voltage applied to said driver input current.

2. The current source of claim 1 wherein said voltage reference comprises a first resistor and a second resistor coupled in series between a first supply voltage and a second supply voltage, said voltage reference output coupled to a node where said first resistor is coupled to said second resistor.

3. A current source with a current source output, capable of driving a large capacitive load and capable of driving Printed Wiring Board signal lines, and maintaining high impedance over a wide range of voltage at said output, comprising:

an FET current source driver, having a gate, a source, and a drain, which operates in both a saturated and a linear region of the FET operating region, a voltage control mechanism with an input and an output, said output coupled to said gate of said FET current source driver, which, for the saturated region of operation of said FET current source driver, provides a constant voltage to said gate of said FET current source driver, and which, for the linear region of operation of said FET current source driver, provides a changing voltage to said gate of said FET current source driver to provide a substantially constant current from said FET current source driver in both the saturated region of operation and a portion of the linear region of operation, the voltage control mechanism further comprising:

a voltage reference with a voltage reference output;

a low-gain differential amplifier having at least one amplifier output, a reference input coupled to said voltage reference output and an amplifier input from said feedback; and a voltage feedback circuit which receives the at least one amplifier output, and which drives the voltage provided to said gate of said FET current source driver; and a feedback connected between said current source output and said input of said voltage control mechanism, said feedback utilized by said voltage control mechanism to control the voltage provided to said gate of said FET current source driver.

4. The current source of claim 3 wherein said voltage reference comprises a first resistor and a second resistor coupled in series between a first supply voltage and a second supply voltage, said voltage reference output coupled to a node where said first resistor is coupled to said second resistor.

5. The current source of claim 3, wherein said voltage feedback circuit comprises:

a current bias source;

a first FET having a gate and a drain coupled to said gate of said FET current source driver, further coupled to said current bias source, and a source coupled to a first output of said low-gain differential amplifier; and a second FET having a gate coupled to a second output of said low-gain differential amplifier, and having a drain coupled to said gate of said first FET.

6. The current source of claim 3, wherein said voltage feedback circuit comprises:

a first FET having a gate and a drain coupled to said gate of said FET current source driver, further coupled to a current bias source, and a source coupled to a supply voltage; and a second FET having a gate coupled to an output of said low-gain differential amplifier, and having a drain coupled to said gate of said first FET.

7. The current source of claim 3, wherein said voltage feedback circuit comprises:

a current bias source; and an FET having a gate and a drain coupled to said gate of said FET current source driver, further coupled to said current bias source, and a source coupled to an output of said low-gain differential amplifier.

8. A current source with a current source output, capable of driving a Printed Wiring Board signal or an electrical transmission line signal over a wide range of voltage, comprising:

a first FET, having a drain coupled to said current source output, a gate, and a source coupled to a first voltage supply;

a second FET, having a gate and a drain coupled to said gate of said first FET, and a source;

a first current bias source;

a load;

a third FET having a source coupled to said first current bias source, a gate coupled to said current source output, and a drain coupled to said source of said second FET, and further coupled to said load;

a voltage reference;

a fourth FET having a source coupled to said first current bias source, a gate coupled to said voltage reference, and a drain;

a fifth FET having a source coupled to said first voltage supply, and a gate and a drain coupled to said drain of said fourth FET;

a sixth FET, having a gate coupled to said gate of said fifth FET, a source coupled to said first voltage supply, and a drain coupled to said gate of said second FET; and a second current bias source, coupled to said gate of said first FET.

9. The current source of claim 8 wherein said first FET, said second FET, said fifth FET and said sixth FET are N-channel Field Effect Transistors, and wherein said third FET and said fourth FET are P-channel Field Effect Transistors.

10. The current source of claim 8 wherein said first FET, said second FET, said fifth FET and said sixth FET are P-channel Field Effect Transistors, and wherein said third FET and said fourth FET are N-channel Field Effect Transistors.

11. The current source of claim 8 wherein said first current bias source and said second current bias source are resistors, one end of each resistor being coupled to a second voltage supply.

12. The current source of claim 8 wherein said voltage reference is a resistive voltage divider coupled between said first voltage supply and a second voltage supply.

13. The current source of claim 8 wherein said load is a resistor having one end coupled to said first voltage supply.

* * * * *